US007906171B2

(12) United States Patent
Jabado et al.

(10) Patent No.: US 7,906,171 B2
(45) Date of Patent: Mar. 15, 2011

(54) METHOD FOR PRODUCTION OF A LAYER HAVING NANOPARTICLES, ON A SUBSTRATE

(75) Inventors: Rene Jabado, Berlin (DE); Ursus Krüger, Berlin (DE); Daniel Körtvelyessy, Berlin (DE); Volkmar Lüthen, Berlin (DE); Ralph Reiche, Berlin (DE); Michael Rindler, Schöneiche (DE)

(73) Assignee: Siemens Aktiegesellschaft, Munich (DE)

( * ) Notice: Subject to any disclaimer, the term of this patent is extended or adjusted under 35 U.S.C. 154(b) by 266 days.

(21) Appl. No.: 11/994,845

(22) PCT Filed: Jul. 3, 2006

(86) PCT No.: PCT/EP2006/063778

§ 371 (c)(1),
(2), (4) Date: Jun. 9, 2008

(87) PCT Pub. No.: WO2007/006674

PCT Pub. Date: Jan. 18, 2007

(65) Prior Publication Data

US 2009/0047444 A1 Feb. 19, 2009

(30) Foreign Application Priority Data

Jul. 7, 2005 (DE) ..... 10 2005 032 711

(51) Int. Cl.
*B05D 1/12* (2006.01)

(52) U.S. Cl. ..... 427/180

(58) Field of Classification Search ..... 427/180
See application file for complete search history.

(56) References Cited

U.S. PATENT DOCUMENTS

| | | | | |
|---|---|---|---|---|
| 2,442,986 | A | 6/1948 | Ransburg | |
| 5,308,367 | A | 5/1994 | Julien | |
| 5,830,538 | A * | 11/1998 | Gates et al. | 427/535 |
| 6,258,733 | B1 * | 7/2001 | Solayappan et al. | 438/785 |
| 6,280,802 | B1 | 8/2001 | Akedo et al. | |
| 2003/0155668 | A1 | 8/2003 | Stalberg et al. | |
| 2004/0121084 | A1 | 6/2004 | Kitani | |
| 2005/0147751 | A1 * | 7/2005 | Sarigiannis et al. | 427/248.1 |

FOREIGN PATENT DOCUMENTS

| | | | |
|---|---|---|---|
| DE | 40 00 885 | A1 | 7/1991 |
| DE | 197 09 165 | A1 | 1/1998 |
| DE | 199 35 053 | A1 | 1/2000 |
| DE | 100 27 948 | A1 | 12/2001 |
| EP | 0 441 300 | A2 | 8/1991 |
| EP | 1 231 294 | A1 | 8/2002 |
| GB | 932923 | A | 7/1963 |
| GB | 2 226 257 | A | 6/1990 |
| JP | 6-128728 | A | 5/1994 |
| WO | 03/006172 | A1 | 1/2003 |

* cited by examiner

*Primary Examiner* — Frederick J Parker
(74) *Attorney, Agent, or Firm* — Young & Thompson

(57) ABSTRACT

The invention relates to a method for producing a layer (110) having nanoparticles (40), on a substrate (100). The invention is based on the object of specifying a method for producing a layer containing nanoparticles, which method can be carried out particularly easily and nevertheless offers a very wide degree of freedom for the configuration and the composition of the layer to be produced. According to the invention, this object is achieved in that nanoparticles (40) are released and a nanoparticle stream (50) is produced in a first process chamber (10), the nanoparticle stream (50) is passed into a second process chamber (80), and the nanoparticles (40) are deposited on the substrate (100) in the second process chamber (80).

7 Claims, 1 Drawing Sheet

METHOD FOR PRODUCTION OF A LAYER HAVING NANOPARTICLES, ON A SUBSTRATE

The invention relates to a method having the features as claimed in the precharacterizing clause of claim 1.

BACKGROUND OF THE INVENTION

In the following text, the expression nanoparticles means particles having a particle size of less than one micrometer. In contrast to the respective same material without a nanoparticle structure, nanoparticles in some cases have highly extraordinary characteristics. This is because of the fact that the ratio of the surface area to the volume of nanoparticles is particularly high; for example, even in the case of spherical nanoparticles comprising a hundred atoms, more than fifty atoms are surface atoms. The high reactivity of the nanoparticles that results from this offers the capability to align materials more specifically than would otherwise be possible for the respective purpose. For example, nanoparticles are used as coating materials. By way of example, a general technical overview of nanotechnology can be found on the Internet page of the German Physikalisch-Technische Bundesanstalt [Federal Physical/Technical Administration].

PRIOR ART

By way of example, German laid-open specification DE 100 27 948 discloses the use of nanoparticles to form emulsions.

U.S. Pat. No. 5,308,367 discloses the application of cubic boron-nitride layers—so-called CBN layers—as material protection layers to tools, in order to lengthen their life. In the case of the method described in the US patent specification, CBN layers are applied to a substrate by means of a physical vapor deposition (PVD) process. No nanoparticles are formed in this process.

Japanese Abstract 06128728A discloses a method for depositing a film composed of superfine particles. The method makes use of a storage chamber in which the superfine particles move to the chamber base as a result of gravity, thus resulting in a concentration gradient. The particles are passed from the storage chamber to a coating chamber, in which the particles are directed at a substrate to be coated.

European laid-open specification EP 1 231 294 discloses a method having the features as claimed in the precharacterizing clause of claim 1; in this method, particles are broken down, in order to achieve very small particle sizes, while being applied to a substrate.

German laid-open specification DE 197 09 165 discloses the idea that it may be advantageous to treat surfaces in the field of motor vehicles with nanoparticles.

OBJECT OF THE INVENTION

The invention is based on the object of specifying a method for producing a layer containing nanoparticles, which method can be carried out particularly easily and nevertheless offers a very wide degree of freedom for the configuration and the composition of the layer to be produced.

SUMMARY OF THE INVENTION

The invention accordingly provides that nanoparticles are released and a nanoparticle stream is produced in a first process chamber. The nanoparticle stream is passed into a second process chamber, and the nanoparticles are deposited on a substrate in the second process chamber. During this process, according to the invention, the nanoparticle stream is passed laterally, in particular parallel, over the surface of the substrate, and the nanoparticles are deposited with the nanoparticle stream directed in this way on the surface of the substrate.

One major advantage of the method according to the invention is that the nanoparticles are produced and released physically separately from the deposition process of the nanoparticles on the substrate. Even before the deposition process, the nanoparticles are therefore fully complete—preferably in she fixed aggregate state—and just have to be incorporated in the layer to be produced on the substrate. Since the nanoparticles are formed physically separately from the nanoparticle deposition process, it is possible to freely determine the character of the nanoparticles, and to influence them, over a much greater range than would be possible if the nanoparticles were to be produced during the course of the deposition process, that is to say at the same time as the process of depositing the layer to be produced; this is because the separation of the two processes allows the process control for the deposition process and the process control for the nanoparticle formation to be optimized separately from one another. For example, the "two-step method" according to the invention allows a considerably larger state range of the phase diagram of the nanoparticles to be exploited technically than in the case of a "single-step production method", in which the materials which constitute the nanoparticles are vaporized and condense into the layer structure, with a chemical reaction taking place, in atomic or ionic form in the course of one and the same process. The method according to the invention therefore makes it possible to produce completely novel layer systems.

Nanoclusters or nanocrystallites in the fixed aggregate state are preferably deposited as nanoparticles on the substrate.

For example, apart from this, a further material—at the same time as the complete nanoparticles—can additionally be deposited as well on the substrate in the second process chamber, and then, together with the nanoparticles, forms the layer having nanoparticles.

According to a first particularly preferred refinement of the method, a carrier gas is enriched with the nanoparticles in order to form the nanoparticle stream in the first process chamber, and the carrier gas which has been enriched with the nanoparticles is passed into the second process chamber. A carrier gas allows the particle stream of the nanoparticles to be adjusted in a particularly finely metered form, and allows the growth of the layer containing nanoparticles to be controlled particularly easily.

The process parameters in the two process chambers are preferably different: for example the process parameters in the first process chamber are optimized specifically with respect to the formation and release of the nanoparticles; the process parameters in the second process chamber are optimized for optimum deposition of the complete nanoparticles. For optimum layer characteristics, a higher pressure is preferably set in the first process chamber than in the second process chamber; the temperature in the first process chamber is preferably lower than the temperature in the second process chamber.

In order to allow the carrier-gas stream which has been enriched with the nanoparticles and is flowing from the first process chamber into the second process chamber to be influenced particularly easily, the carrier gas stream is preferably passed via a restriction device. The restriction device is then used to set or control the flow speed of the carrier gas into the second process chamber. For example, the restriction device can be used to deliberately influence the deposition rate of the nanoparticles within the second process chamber, or at least also to influence it.

According to a second particularly preferred refinement of the method, the nanoparticles are released in the first process chamber and are moved in the direction of the second process chamber by means of an external electromagnetic field, forming the nanoparticle stream.

An effusion cell is preferably used as the first process chamber in order to produce the nanoparticle stream.

By way of example, the described method can be used to produce an anticorrosion layer, an adhesion layer, a wear protection layer, a sensor layer or a catalytic layer.

The invention also relates to an arrangement for producing a layer having nanoparticles, on a substrate.

With respect to an arrangement such as this, the invention is based on the object of allowing a particularly high degree of freedom for the configuration and the composition of the layer to be produced.

According to the invention, this object is achieved in that a first process chamber is provided which is suitable for releasing nanoparticles and for producing a nanoparticle stream, and in that the first process chamber is connected to a second process chamber into which the nanoparticle stream is passed, and in which the nanoparticles are deposited on the substrate.

With regard to the advantages of the arrangement according to the invention and with regard to advantageous refinements of the arrangement, reference should be made to the above statements relating to the method according to the invention.

BRIEF DESCRIPTION OF THE DRAWING

The invention will be explained in the following text with reference to three exemplary embodiments. In the figures.

The same reference symbols are used for identical or comparable components in FIGS. 1 to 3.

DETAILED DESCRIPTION OF THE INVENTION

Figure 1:
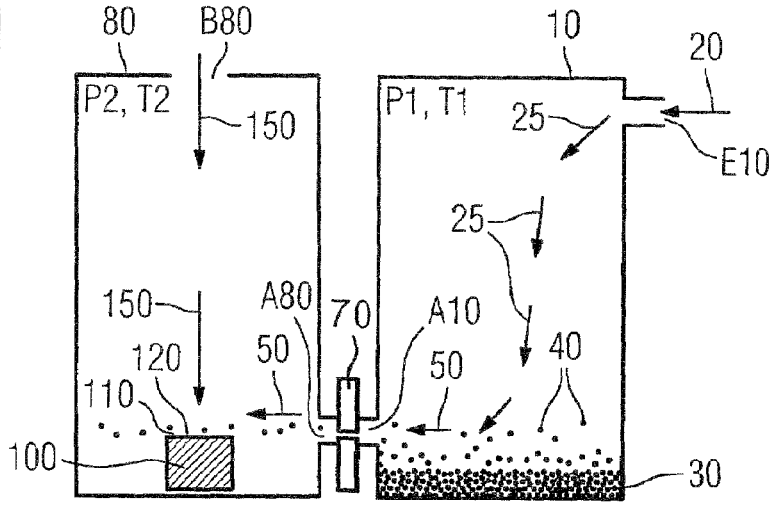
FIG. 1 shows a first exemplary embodiment of an arrangement according to the invention for producing a layer having nanoparticles, with a carrier gas being used to form a nanoparticle stream.

FIG. 1 shows a first process chamber, which is formed by an effusion cell 10. The effusion cell 10 has an inlet opening E10 into which a carrier gas 20—symbolized by an arrow—is fed into the effusion cell 10. The further gas flow of the carrier gas 20 is indicated by further arrows 25 in FIG. 1.

The effusion cell 10 contains a nanoparticle base material 30 by means of which nanoparticles 40 are formed and released in a manner which is not illustrated in any more detail in FIG. 1. The released nanoparticles 40 are held by the carrier gas 20 so that a nanoparticle stream 50 is formed, which points to the left in FIG. 1 and is directed at an outlet opening A10 of the effusion cell 10.

The outlet opening A10 of the effusion cell 10 is connected to a restriction device 70, whose output side is connected to a first inlet opening A80 of a second process chamber 80. The second process chamber 80 is a reactor chamber, which is located in a hard vacuum. The pressure P2 in the reactor chamber 80 is preferably in the range between $10^{-5}$ mbar and 1 mbar.

A substrate 100, on which a layer 110 having nanoparticles 40 is intended to be deposited, is arranged within the reactor chamber 80. The substrate 100 is arranged in the area of the first inlet opening A80 of the reactor chamber 80 such that the nanoparticle stream 50 which leaves the effusion cell 10 and passes through the restriction device 70 flows laterally over the surface 120 of the substrate 100, leading to deposition of the nanoparticles 40 on the surface 120 of the substrate 100, and resulting in the formation of the layer 110.

In the exemplary embodiment shown in FIG. 1, the layer 110 is not intended to be composed exclusively of nanoparticles 40; in fact, the aim is to form a layer 110 which contains further materials as well as the nanoparticles 40. For this purpose, the reactor chamber 80 has a second inlet opening B80 through which a material flow 150 of further material is passed into the reactor chamber 80. The material flow 150 is directed such that it passes the further material directly to the surface 120 of the substrate 100. The material stream 150 preferably strikes the surface 120 of the substrate 100 at right angles; the material stream 150 is therefore likewise at right angles to the nanoparticle stream 50, which is preferably directed parallel to the surface 120 of the substrate 100. The further material contained in the material stream 150 as well as the nanoparticles 40 in the nanoparticle stream 50 jointly form the layer 110, which is deposited on the surface 120 of the substrate 100.

In the exemplary embodiment shown in FIG. 1, the nanoparticles 40 are transported via the carrier-gas stream 20 into the reactor chamber 80. In order to create a gas flow from the effusion cell 10 into the reactor chamber 80, the pressure P1 in the effusion cell 10 is higher than the pressure P2 in the reactor chamber 80. The pressure within the effusion cell 10 is preferably in a pressure range between $10^{-2}$ mbar and $10^{-5}$ mbar.

By way of example, nanoclusters or nanocrystallites may be formed as nanoparticles 40. For example, a cBN (cubic) material can be used as the nanoparticle base material 30 in order to produce wear-protection layers.

Figure 2:
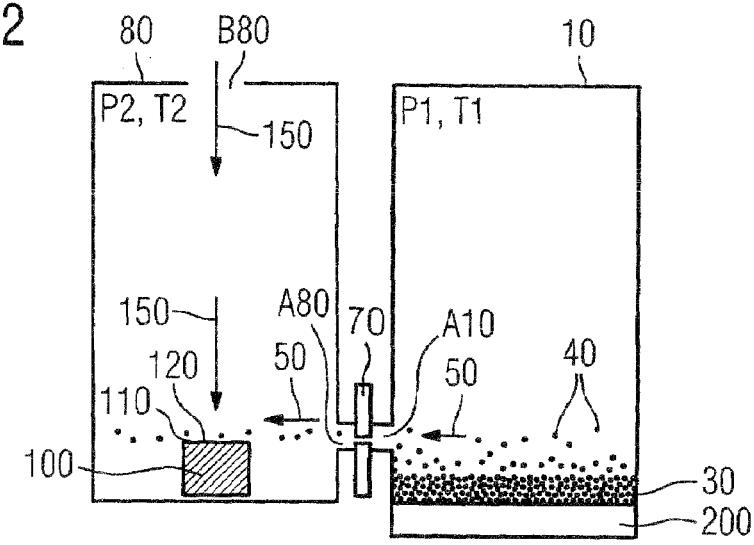
FIG. 2 shows a second exemplary embodiment of an arrangement for producing a layer such as this, with an electromagnetic device being used to form a nanoparticle stream.

FIG. 2 shows a second exemplary embodiment of an arrangement for producing a layer 110 having nanoparticles 40. In contrast to the exemplary embodiment shown in FIG. 1, the nanoparticle stream 50 is produced electromagnetically. Specifically, the effusion cell 10 has an electromagnetic device 200 which is arranged in the effusion cell 10 or adjacent to the effusion cell 10; in the example shown in FIG. 2, the electromagnetic device 200 is fitted to the effusion cell 10 at the bottom. The electromagnetic device 200 produces an electromagnetic field such that the nanoparticles 40 formed from the nanoparticle base material 30 form a nanoparticle stream 50 which leaves the effusion cell 10 in the direction of the reactor chamber 80, and is then fed into the reactor chamber 80.

Apart from this, the arrangement shown in FIG. 2 corresponds to the arrangement shown in FIG. 1.

Figure 3:
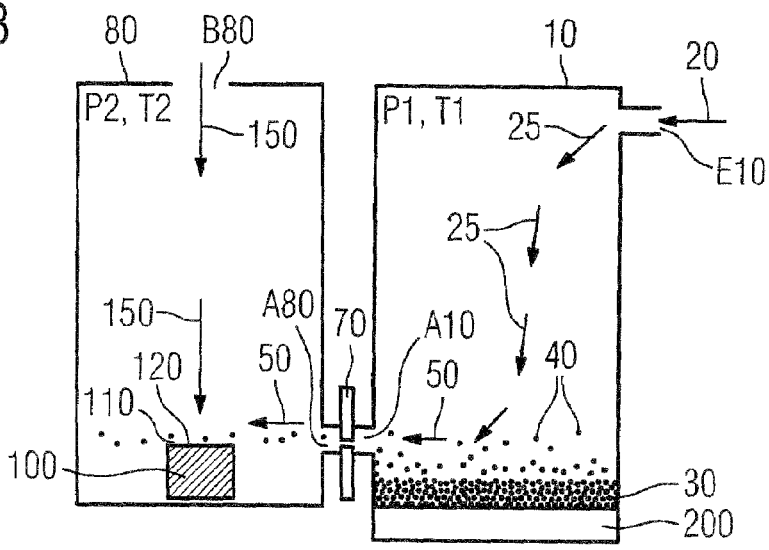
FIG. 3 shows a third exemplary embodiment of an arrangement for producing a layer such as this, with a carrier gas and an electromagnetic device being used to form a nanoparticle stream.

FIG. 3 shows a third exemplary embodiment of an arrangement for producing a layer 110 containing nanoparticles 40. In this third exemplary embodiment, the nanoparticle stream 50 is formed by interaction of a carrier gas 20 and an electromagnetic device 200. The nanoparticle stream 50 is therefore formed by superimposition of two forces which act on the nanoparticles 40: these are, firstly, the electromagnetic force of the electromagnetic device 200 and, secondly, the mechanical movement force resulting from the flow of the carrier gas 20.

The invention claimed is:

1. A method for producing a layer (110) having nanoparticles (40), on a substrate (100), wherein nanoparticles (40) are released and a nanoparticle stream (50) is produced in a first process chamber (10), the nanoparticle stream (50) is passed into a second process chamber (80), with the nanoparticle stream being passed laterally over a surface (120) of the substrate (100) which is located in the second process chamber (80), and the nanoparticles (40) are deposited with the nanoparticle stream directed on the substrate (100) in the second process chamber (80), characterized in that at least one further material is additionally deposited on the substrate in the second process chamber and, together with the nanoparticles, forms the layer having nanoparticles, wherein the further material is passed in the form of a material stream (150) to the surface (120) of the substrate (100), wherein the further material stream (150) is aligned such that it strikes the surface of the substrate (100) at right angles and an effusion cell (10) is used as the first process chamber, and the nanoparticle stream is produced in the effusion cell.

2. The method as claimed in claim 1, characterized in that the nanoparticles (40) within the first process chamber (10) are accelerated with the aid of an electromagnetic field (200) parallel to the surface (120) of the substrate (100) which is located in the second process chamber, and are moved in the direction of the second process chamber, forming the nanoparticle stream (50).

3. The method as claimed in claim 1, characterized in that a carrier gas (20) is enriched with the nanoparticles (40) in order to form the nanoparticle stream in the first process chamber, and the carrier gas which has been enriched with the nanoparticles is passed into the second process chamber (80).

4. The method as claimed in claim 3, characterized in that the carrier gas which has been enriched with the nanoparticles is passed from the first process chamber into the second process chamber via a restriction device (70), and in that the restriction device is used to adjust the gas flow of the carrier gas into the second process chamber.

5. The method as claimed in claim 4, characterized in that the restriction device is used to adjust the rate of deposition of the nanoparticles within the second process chamber.

6. The method as claimed in claim 1, characterized in that a lower pressure (P2) is set in the second process chamber than in the first process chamber.

7. The method as claimed in claim 1, characterized in that nanoclusters or nanocrystallites are deposited as nanoparticles on the substrate.

* * * * *